US005542896A

United States Patent [19]

Qaiesi et al.

[11] Patent Number: 5,542,896

[45] Date of Patent: Aug. 6, 1996

[54] LIMB ENCIRCLING EXERCISE WEIGHT WITH MOUNTING STRUCTURES

[76] Inventors: Husein O. Qaiesi, 16043 Springfield, Markham, Ill. 60426; Michael A. Groves, 2144 W. Arthur, Apt. 2, Chicago, Ill. 60645

[21] Appl. No.: 415,653

[22] Filed: Apr. 3, 1995

[51] Int. Cl.[6] ..... A63B 21/065

[52] U.S. Cl. ..... 482/105

[58] Field of Search ..... 482/105, 124, 482/126, 148; 601/27, 34, 40

[56] References Cited

U.S. PATENT DOCUMENTS

| | | | |
|---|---|---|---|
| 3,334,898 | 8/1967 | McCrory et al. | 482/105 |
| 3,490,766 | 1/1970 | Gardner | 482/105 |
| 4,247,097 | 1/1981 | Schwartz . | |
| 4,322,072 | 3/1982 | White . | |
| 4,556,215 | 12/1985 | Tarbox et al. . | |
| 4,575,075 | 3/1986 | Tarbox et al. . | |
| 4,838,546 | 6/1989 | Winston . | |
| 5,127,891 | 7/1992 | Winston . | |
| 5,267,927 | 12/1993 | Catanzano et al. . | |
| 5,336,708 | 8/1994 | Chen . | |

*Primary Examiner*—Stephen R. Crow
*Attorney, Agent, or Firm*—David S. Thompson

[57] ABSTRACT

A bearable exercise weight is disclosed. Several versions of the invention are disclosed, each providing a limb encircling weight having an adjustable restraint which holds the weight in a circular configuration about the distal end of a limb. An anchoring structure, in the form of a sock, shoe or glove, is also provided, and functions to keep the weight in place at the end of the limb. Several structures are disclosed which function as means of attachment, connecting the anchoring structure to the limb encircling weight. One version of the invention provides an ankle encircling weight unit with a strip of each sex of VELCRO lengthwise along its lower portion and tabs with shoe lace holes at each end of the unit. A strip of VELCRO provides similar strips of each sex of VELCRO and is adhered to the collar of the shoe. The strip folds from a first position whereby the strips are engaged by each other, to a second position where the strips engage the strips on the ankle encircling weight unit. The user then laces the shoe's existing shoe laces through the lace holes on the tabs and secures the unit in place.

5 Claims, 4 Drawing Sheets

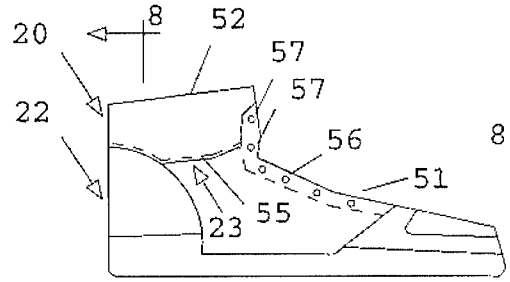
FIG. 7
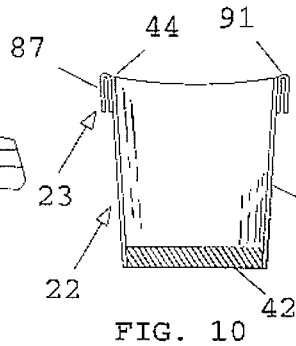
FIG. 10
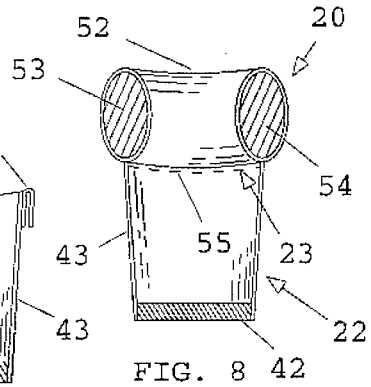
FIG. 8
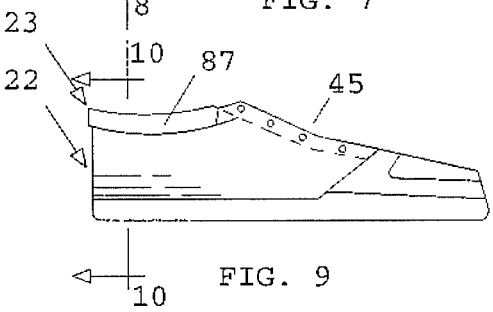
FIG. 9
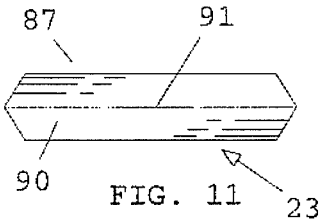
FIG. 11
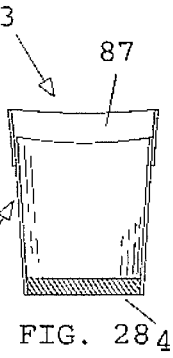
FIG. 28
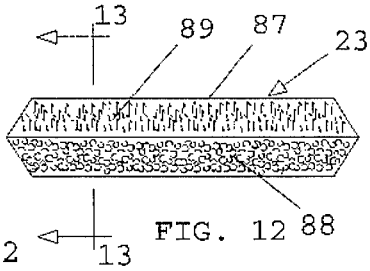
FIG. 12
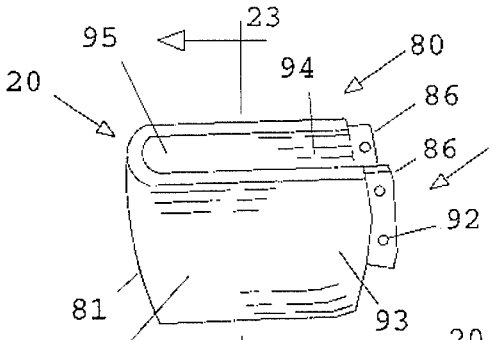
FIG. 14
FIG. 13
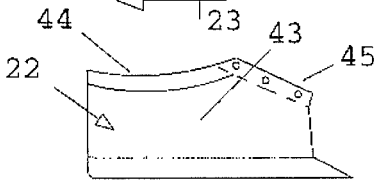
FIG. 15
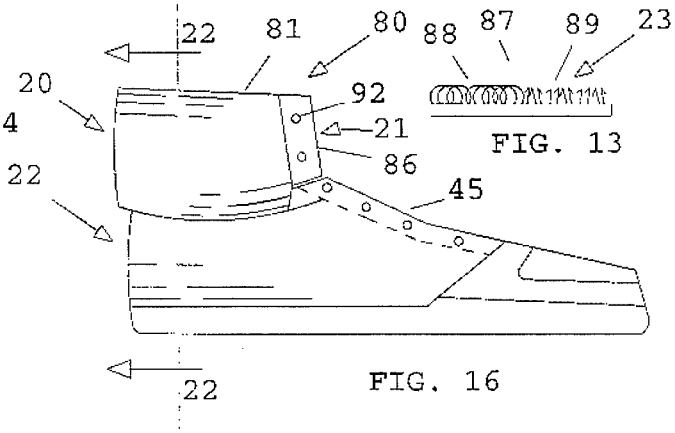
FIG. 16

LIMB ENCIRCLING EXERCISE WEIGHT WITH MOUNTING STRUCTURES

CROSS-REFERENCES

There are no applications related to this application filed in this or any foreign country.

BACKGROUND

A number of exercise weights adapted to be worn by athletes and others involved in physical training have been developed to give the user the benefit of extra resistance which tends to increase muscle tone. Weights intended to be worn in the area of the hand or foot tend to have the most utility, since movement of the extremity, either hand or foot, tends to exercise the entire associated limb. Unfortunately, most previously known exercise weights have failed to adequately address the problem of movement of the weight relative to the portion of the body supporting it. As a result, most weights tend to move up and down the arm or leg of the user, or tend to bounce during exercise. Such undesirable movement is difficult to avoid, since the mass of the weight by definition results in considerable inertia, and therefore often considerable force tends to move the weight in an objectionable manner.

To counter this tendency, various ideas and structures have been put forth, but a complete solution has not yet been found. Frequently weights intended for physical conditioning of the arm have required the user to grip one weight in each hand. This tends to counter the problem of objectionable movement of the weight, but prevents use of the hands for other purposes. Ankle weights, for use in conditioning the leg, may not be similarly constrained, and a result ankle weights tend to bounce when the user runs or otherwise exercises.

For the foregoing reasons, what is needed is an exercise device that tends to prevent weight movement relative to the user's body. The exercise device must have a limb encircling weight that is held in place relative to the limb by an adjustable restraint, and that is additionally held in place by an anchor structure that is attached to an extremity.

SUMMARY

The present invention is directed to an apparatus that satisfies the above needs. A novel limb encircling exercise weight that provides means to secure it in place and means to anchor it to an extremity (either hand or foot) is provided.

The limb encircling exercise weight of the present invention provides:

(a) a cover containing a filling of a high-density material;

(b) an adjustable restraint for biasing the limb encircling weight in a manner that holds the weight tightly against the user's wrist or ankle;

(c) an anchor structure, typically a glove, shoe or ankle supporter, which prevents the weight from moving up and down the arm or leg during exercise; and (d) a means of attachment for connecting the cover of the limb encircling weight to the anchoring structure.

A preferred version of the limb encircling exercise weight of the present invention is attachable by VELCRO to the top of an athletic shoe, and provides:

(a) a cover containing a filling of a high-density material, suitably shaped to fit about the user's ankle;

(b) tabs at each end of the cover, each tab having shoe lace holes, so that the user may tighten the cover about the ankle using the laces of the shoe;

(c) a strip of male VELCRO and a strip of female VELCRO running the length of the cover, toward the lower portion of the cover, and directed inwardly, toward the user's shoe; and (d) a convertible band, attached to the collar of the shoe by adhesive, having two parallel strips of oppositely sexed VELCRO, which may be folded against each other when not in use, or which may be separated and attached to the VELCRO strips on the inside of the cover to firmly attach the weight to the top of the athletic shoe.

It is therefore a primary advantage of the present invention to provide a novel limb encircling exercise weight having a restraining structure to hold the weight firmly to the end portion of a user's limb.

Another advantage of the present invention is to provide a limb encircling exercise weight having an extremity griping anchor, which may include a glove, sock or shoe, and which prevents the weight from sliding up and down the user's arm or leg during exercise.

A still further advantage of the present invention is to provide a limb encircling exercise weight having means to attach that weight to the anchor structure. In one version of the invention, this structure takes the form of a convertible band, which attaches by means of adhesive to the top of a user's shoe, and attaches by means of VELCRO to the cover of an ankle encircling exercise weight.

DRAWINGS

These and other features, aspects, and advantages of the present invention will become better understood with regard to the following description, appended claims, and accompanying drawings where:

FIG. 7 shows a version of the, invention having a limb encircling weight built into the upper portion of an athletic shoe;

FIG. 8 shows a cross-section of the rear portion of the shoe seen in FIG. 7, taken on the 8—8;

FIG. 9 shows a shoe having the attachment means seen in FIG. 6 turned downwardly;

FIG. 10 shows a cross-section of the shoe seen in FIG. 9, taken on the 10—10 lines;

FIG. 11 shows a back view of the convertible VELCRO strip of FIG. 6;

FIG. 12 shows a top view of the convertible VELCRO strip of FIG. 6;

FIG. 13 shows a cross-sectional view of the convertible VELCRO strip of FIG. 12, taken along the 13—13 lines;

FIG. 14 shows a perspective view of the limb encircling weight attachable to the convertible VELCRO strip of FIG. 6;

FIG. 15 shows the shoe of FIG. 9 with the attachment means removed;

FIG. 16 shows a side orthographic view of the version of the invention of FIG. 14;

DESCRIPTION

Figure 1:
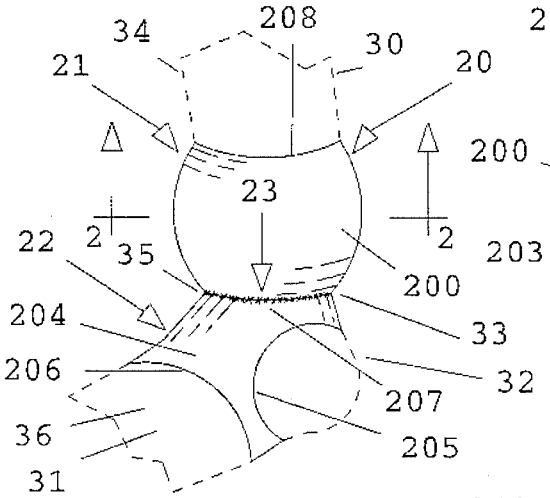
FIG. 1 shows a version of the invention having a tubular elastic limb encircling weight and an anchor formed by a ankle supporter.

The present invention is directed to a limb encircling exercise weight 20 which provides an adjustable restraint 21 which holds the weight 20 firmly in place on the end portion of the limb, either arm or leg, near a joint 35 which is either the wrist 38 or ankle 33. An anchor structure 22 attaches to an extremity, either a hand or a foot, of a user and also to the limb encircling weight 20, which prevents the weight from traveling up or down the user's limb during exercise. An attachment structure 23 connects the anchor 22 to the weight 20.

A first version of the invention provides a limb encircling weight 20, as seen in FIG. 16, and an anchor 22, which here takes the form of shoe 45. An adjustable restraint 21 allows the user to tighten the encircling weight 20 about the user's ankle. Attachment means 23, in the form of convertible band attachment 87, is seen in FIGS. 6, 9–13, 22 and 28, and functions to attach weight 20 to anchor 22.

Figure 23:
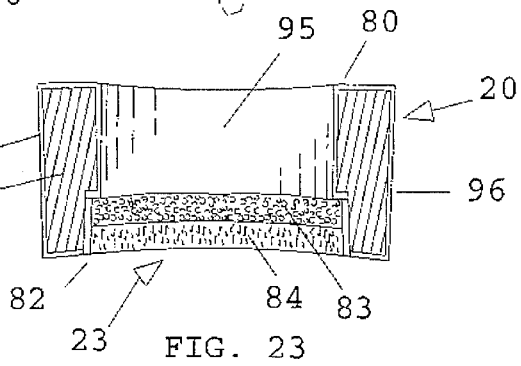
FIG. 23 shows a cross-sectional view of the limb encircling weight of FIG. 14, taken along the 23—23 lines.

Referring to FIG. 14, the limb encircling weight 20 takes the form of weight unit 80. A cover 81 is formed of heavy cloth, leather or plastic, and is suited for wrapping about the user's ankle. The cover 81 is generally elongate, having tabs 86 at both the first and second end portions 93, 94. The cover provides an inside 95, and an outside 96, as seen in FIGS. 14 and 23. The length of the cover is approximately the circumference of the typical user's ankle or the length of the perimeter of the collar 44 of an athletic shoe. The height of the cover is usually between 2 and 4 inches, and is typically sized so that when attached to a low-top athletic shoe, that shoe then resembles a high-top athletic shoe. The thickness of the weight unit 80 is typically between 0.5 and 1.0 inches, but may vary somewhat.

As seen in FIG. 23, a dense material 85, serves to provide an overall mass that is sufficient to meet the typical athlete's requirements, and may average about 2 to 5 pounds. In the preferred embodiment, dense material takes the form of lead shot that is similar to that used in shotgun shells. Alternatively, the dense material may be made from steel waste material produced when hardware is produced. For example, the round centers of washers, which are typically stamped out as the washers are produced, may be used as the dense material. The characteristics that indicate a good dense material, in addition to high mass per unit volume, are small size and smooth surfaces. The circles stamped from washers have all three characteristics, density, small size, and smooth surfaces.

Adjustable restraint 21 comprises tabs 86 having lace holes 92, as seen in FIGS. 14 and 16. Tabs 86 are typically made of leather, but may alternatively be made of plastic or other suitable material. Referring to FIG. 16, holes 92 are positioned so that they are in the alignment required to be laced together using the same laces that tied the lace holes in shoe 45. Tabs 86 are connected to the cover 81 by known means, such as stitching or other fasteners. The adjustable restraint means 21 allows the user to bias weight unit 80 around an ankle.

Referring again to FIG. 23, attachment means 23 is seen to comprise a strip of loop or female VELCRO 83, and a strip of male or hook VELCRO 84. Both VELCRO strips 83, 84 are sewn or otherwise attached to the lower, inside position of cover 81, and are generally adjacent and parallel to each other. An indentation 82 tends to create a flush fit between convertible band 87 (as seen in FIG. 28) and the inside portion 95 of the cover 81, as will be seen below.

Attachment means 23 for the first version of the invention provides a convertible band 87, as seen in FIGS. 6, 9–13. The band 87 is a thin, flexible and elongate band having a first side having an adhesive strip 90 and a second side having a strip of loop (female) VELCRO 88 and an adjacent and generally parallel strip of hook (male) VELCRO 89. The first side may be attached to the collar or upper rim 44 of a shoe by means of adhesive strip 90.

FIG. 15 shows a typical athletic shoe 45 which serves as the anchor means 22 of the first species of the invention. The shoe side 43 and upper rim or collar 44 are seen. FIG. 9 shows a similar shoe with convertible band 87 attached to collar 44. As seen in FIG. 9, the convertible band is in a downward position, with oppositely sexed VELCRO strips 87, 88 engaged, as seen in the cross-sectional view of FIG. 10. The band 87 will convert to an upward positions, as seen in cross-section in FIG. 28, and in side-view in FIG. 6. A fold or fold line 91, best seen in FIGS. 10 and 11, allows the user to alternate the convertible band 87 between the the upper (FIG. 28) and lower (FIG. 10) positions.

Figure 25:
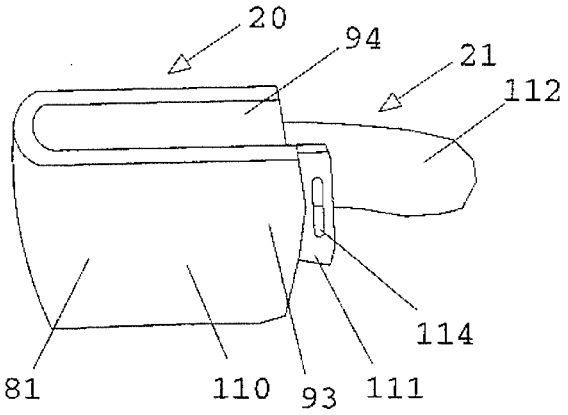
FIG. 25 shows perspective view of the limb encircling weight of FIG. 24.
Figure 24:
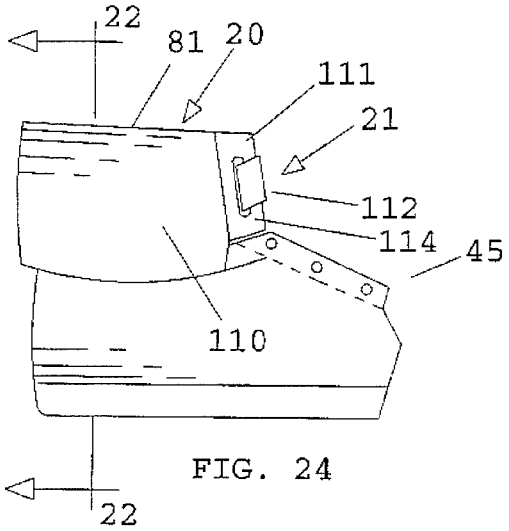
FIG. 24 shows a side view of a version of the invention, very similar to the version of the invention seen in FIG. 14, but having a VELCRO adjustable restraint.
Figure 27:
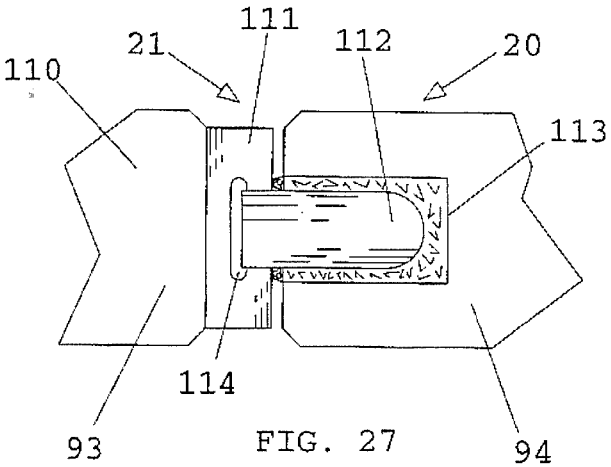
FIG. 27 shows a detailed view of the adjustable restraint of the limb encircling weight of FIG. 25.

A second version of the invention is similar to the first version, but provides an alternative structure for the adjustable restraint 21. As seen in FIG. 25, a weight unit 110 has a first end 93 and a second end 94. Attached to the second end 94 is a single elongate strap 112 having loop (female) VELCRO on one side. A strap base 113, having a covering of hook (male) VELCRO, is sewn or otherwise fastened to the first end 94 of the weight unit 110. Attached to the first end 93 is a tab 111 having a slot 114. The slot 114 is sized to allow the strap 112 pass through, as seen in FIG. 27. The loop VELCRO of the strap 112 may then be engaged with the hook VELCRO of the base 113, as seen in FIG. 27. FIG. 24 shows the second version of the invention attached to a shoe 45.

Figure 26:
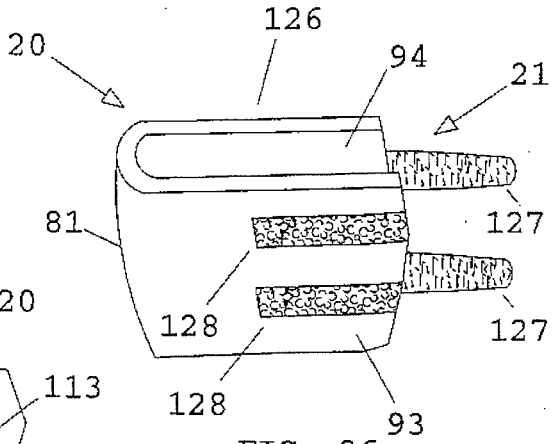
FIG. 26 shows perspective view of a version of the invention similar to the version seen in FIG. 25, but having dual VELCRO straps as the adjustable restraint means.

A third version of the invention is seen in FIG. 26. This version of the invention varies from the first two versions only in that the adjustable restraint 21 provides an alternative structure. Continuing to refer to FIG. 26, the weight unit 126 provides a first end portion 93 having two strips 128 of loop VELCRO. A second end portion 94 supports a pair of straps 127 having hook VELCRO on their inner side. Straps 127 and strips 128 are configured in a manner that allows the user to adjust the tightness of the weight unit 126 about the ankle.

A fourth version of the invention is seen in FIGS. 7 and 8. A limb encircling weight 20 is formed by a padded upper shoe portion 52 of high-top athletic shoe 51. A cavity 54 inside padded portion 52 carries dense material 53, which is typically lead shot.

Adjustable restraint 21, which biases the weight around the user's ankle, is formed by upper shoe lace holes 57, which are a continuation of the array of lower shoe lace holes 56.

Anchor 22, which keeps weight 20 from moving about the user's leg, is formed by the portion of high-top shoe 51 below the padded upper portion 52.

Attachment means 23, which connects the weight 20 to the anchor 22 is represented in this version of the invention by stitching 55, as seen in FIG. 7, which attaches the padded upper portion 52 to the shoe 51.

Figure 17:
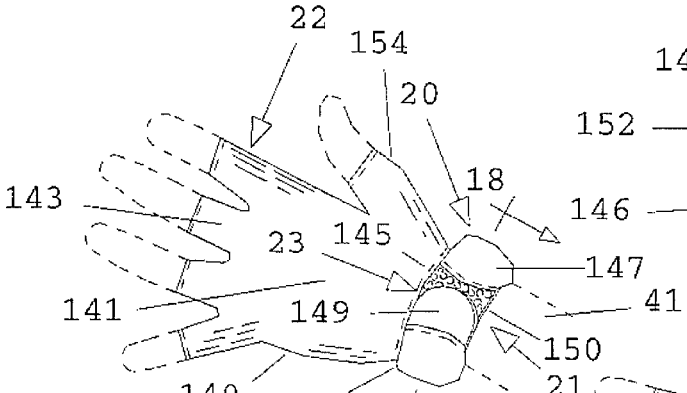
FIG. 17 shows a palm side view version of the invention having a full glove and a wrist encircling weight.
Figure 18:
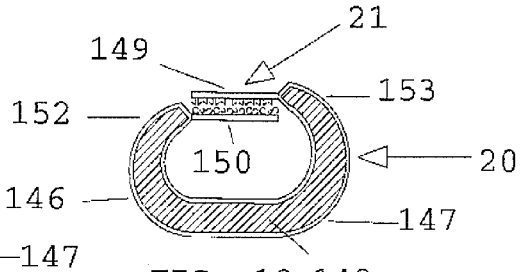
FIG. 18 shows a cross-section of the wrist encircling weight of FIG. 17, along the 18—18 lines.
Figure 19:
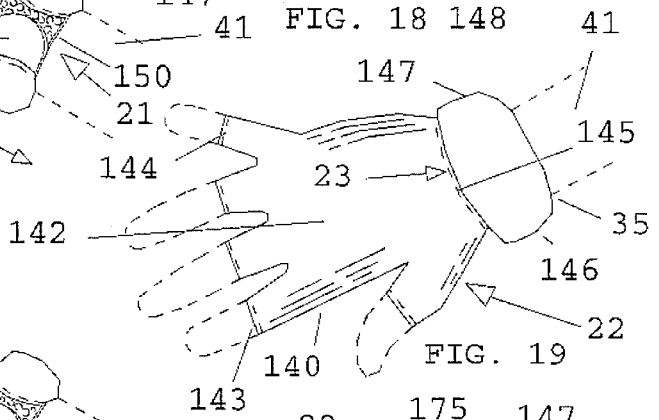
FIG. 19 shows a back view of the version of the invention seen in FIG. 17.

A fifth version of the invention is seen in FIGS. 17, 18, and 19. A limb encircling weight 20 provides a wrist weight unit 146 having a cover 147 having a first end 152 and a second end 153. A filling of dense material 148 is typically lead shot.

An adjustable restraint 21 comprises a tab 149 with hook VELCRO carried by the second end portion 153, and a tab 150 with loop VELCRO is carried by the first end portion 152. The VELCRO on tabs 149, 150 is positioned so that the tabs may be releasably connected, as seen in FIG. 18, in an adjustable manner to allow the user to adjust the tightness of the wrist weight unit 146 about the wrist.

An anchor 22 comprises a full glove 140 having a palm portion 141 and a full back portion 142 (as opposed to the partial back of the partial glove). Abbreviated fingers 143 allow the distal approximately one-half of each of the user's fingers to protrude from the glove. Similarly, an abbreviated thumb 154 allows approximately one-half of the user's thumb to protrude from the glove. The abbreviated fingers and thumb may provide a hem-like stitching 144, particularly where cloth that tends to unravel is used to make the glove. Where leather or other similar materials are used to make the glove 140, no hem may be necessary.

Attachment means 23 provides stitching 145 which attaches the glove 140 to the cover 147 of the wrist weight unit 146.

Figure 20:
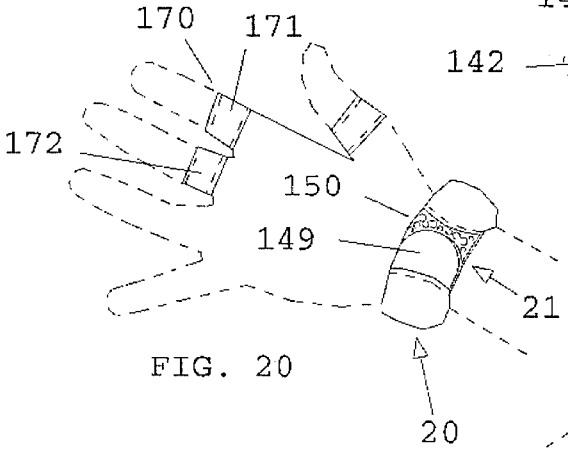
FIG. 20 shows a palm side view version of the invention having a partial glove and wrist encircling weight.
Figure 21:
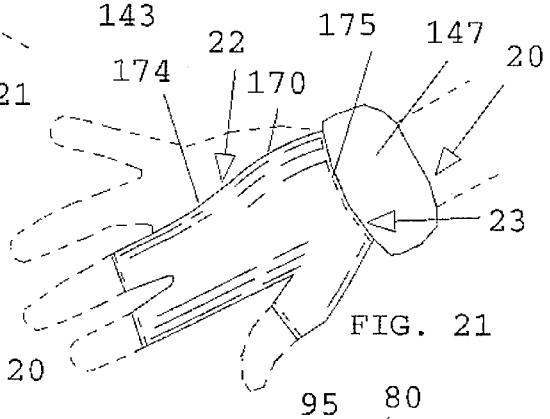
FIG. 21 shows a back view of the version of the invention seen in FIG. 20.
Figure 22:
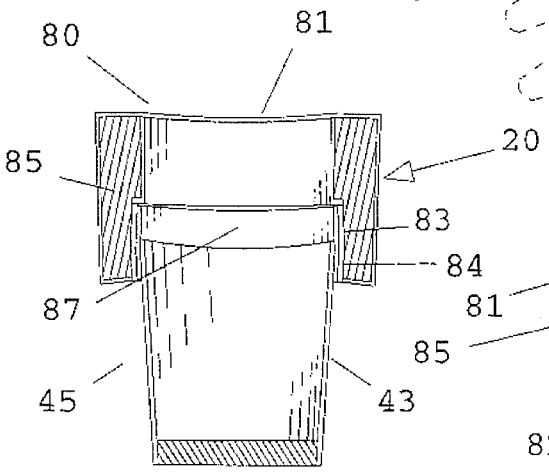
FIG. 22 shows a cross-sectional view of the shoe and ankle encircling weight of FIG. 16, taken along the 22—22 lines.

A sixth version of the invention is similar to the fifth version, but provides an alternative structure for the anchor 22. As seen in FIGS. 20 and 21, anchor 22 comprises a partial glove 170 having a partial back 174 which tends to cover the knuckles of the index and second fingers, while leaving uncovered the ring and little fingers, as well as the back of the hand between those fingers and the wrist. An index finger loop 171 and a second finger loop 172 attach the partial glove to the index and second fingers. Similarly, a thumb loop 173 attaches the partial glove 170 to the thumb. The thumb and finger loops may be formed apart from the partial back and sewn onto the partial back, or formed from the same piece of material as the back. Attachment means 23 comprises stitching 175, which attaches the partial back 174 to the cover 147.

Figure 2:
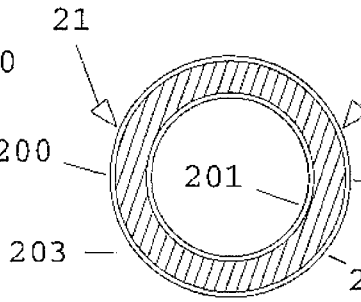
FIG. 2 shows a cross-section of the limb encircling weight of FIG. 1, taken on the 2—2 lines.

A seventh version of the invention is seen in FIGS. 1 and 2. A limb encircling weight 20 comprises an elastic ankle weight unit 200 which provides an endless flexible tube 201 filled with a dense material 203 which may be lead shot or other similar material.

An adjustable restraint 21, comprising resilient material such as elastic covering 202, which forms tube 201, adjusts to fit the lower leg 30 of the user, as seen in FIG. 1, and biases the lead shot 203 against the user's leg.

An anchor 22 comprises an ankle supporter 204, having an opening 205 for the user's heal 32, a toe end opening 206 for the front portion 36 of the user's foot 31. An opening 208 in the upper portion to the ankle supporter allows the lower portion 34 of the user's leg 30 to pass. The ankle supporter 204 is typically made of an elastic fabric or other material that firmly grips the foot 31.

Attachment means 23 provides stitching 207 which attaches the ankle supporter 204 to the elastic ankle weight unit 200.

Figure 5:
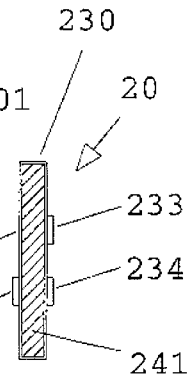
FIG. 5 shows a cross-section of the limb encircling weight of FIG. 4, taken on the 5—5 lines.
Figure 4:
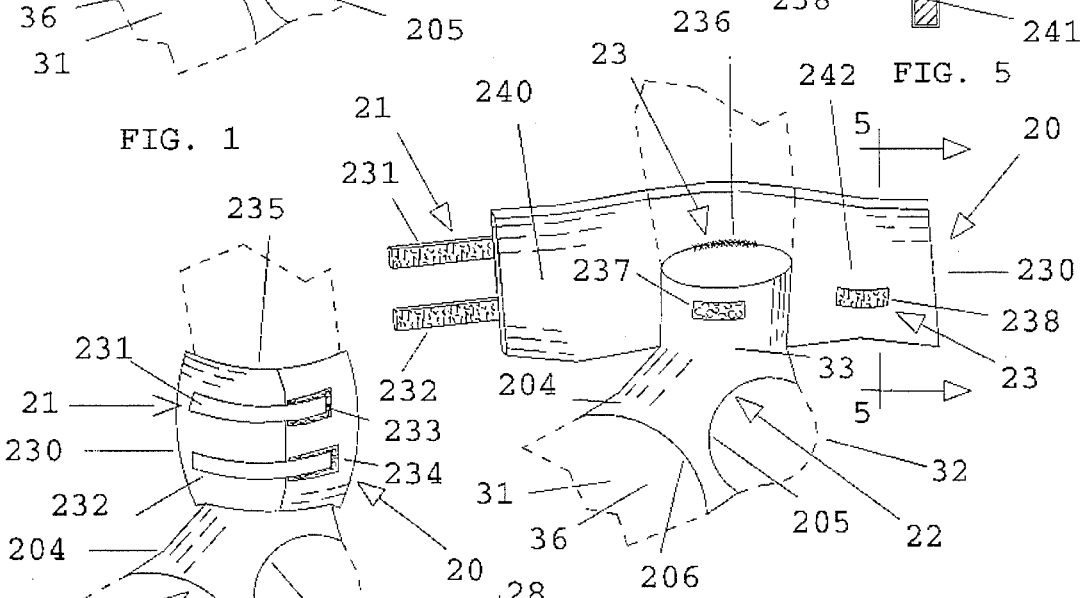
FIG. 4 shows the version of the invention of FIG. 3, showing the adjustable restraint opened.
Figure 3:
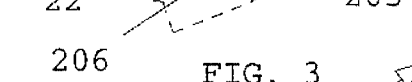
FIG. 3 shows a version of the invention having a limb encircling elongate ankle weight and an anchor formed by an ankle supporter.

A eighth version of the invention is seen in FIG. 3, 4 and 5. A limb encircling weight 20 comprises an ankle weight 230, which is seen in a position wrapped about the ankle of a user in FIG. 3, and in an open position in FIG. 4. The weight 230 provides a cover 240 that is typically made of a heavy duty fabric or leather and a filling inside the cover of a dense material 241 that is typically formed of lead shot. The dense material is seen in FIG. 5.

An adjustable restraint 21, comprising upper and lower attachment straps 231, 232 and upper and lower attachment strips 233, 234, is adjustable to cause the weight 230 to fit the lower leg of the user. Upper and lower attachment straps 231,232, are typically made of heavy fabric or leather and have a backing of hook (male) VELCRO. Upper and lower attachment strips 233, 234 are typically made of loop (female) VELCRO and are sewn onto the cover, as seen in FIGS. 3 and 5.

An anchor 22 comprises an ankle supporter 204, which is similar to the ankle supporter described above, in FIG. 1.

Attachment means 23, comprises stitching 236 which attaches the ankle supporter 204 to the ankle weight unit 230 and also releasably attachable VELCRO patches 237, 238. As seen in FIG. 4, a loop (female) VELCRO patch 237 is sewn onto the sock 204. A similarly sized hook (male) VELCRO patch 238 is attached to an inside portion 242 of the cover 240 of the ankle weight 230.

Figure 6:
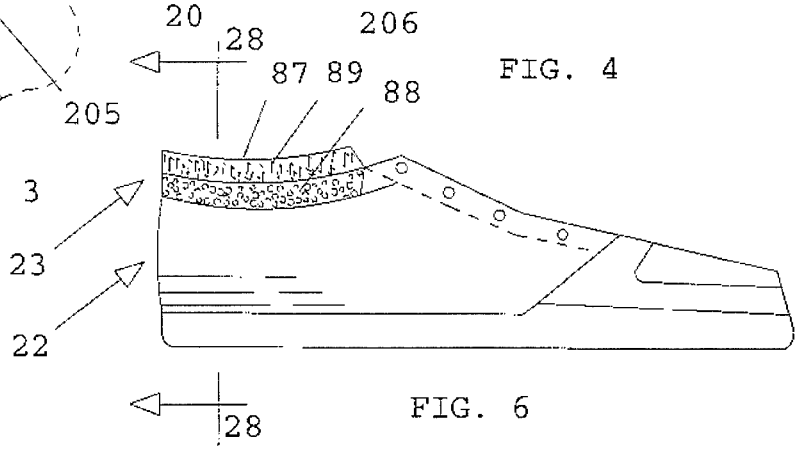
FIG. 6 shows a version of the invention having a convertible VELCRO strip version of the attachment means of the invention.

The first version of the invention, seen in FIGS. 6, 9–14, and 16, is used in the following manner. First, the user applies the adhesive strip 90 of the convertible band 87 to the collar 44 of each athletic shoe 45, so that the convertible band appears as illustrated in FIG. 9. Next, the user puts on the shoes seen in FIG. 9 but does not lace them. The convertible band 87 is then manually moved from a lower position, as seen in FIGS. 9 and 10, to an upper position, as seen in FIGS. 6 and 28. After the convertible band is raised in this manner, a loop VELCRO strip 88 and a hook VELCRO strip 89 are available, as seen in FIG. 6, to mate with the associated hook and loop VELCRO strips 84, 83 of the weight unit 80 with lace holes, as seen in FIG. 14. The user manually positions the weight unit 80 on convertible band 87. The user then uses the shoe laces of the shoe 45 to lace the lace hole 92 of the weight unit 80. At this point, all leg movement made by the user will result in additional athletic conditioning. The weight unit may be removed by reversing the above steps, and by moving the convertible band 87 to the lower position seen in FIGS. 9 and 10, wherein VELCRO strips 88 and 89 are mated together.

Use of the second version of the invention, as seen in FIG. 24, is similar to the use of the first version of the invention, but rather than tying the shoe laces into holes 92, the user feeds strap 112 through slot 114 in tab 111, as seen in FIG. 27. The loop VELCRO on strap 112 is then mated to the hook VELCRO on the strap base 113.

Similarly, the use of the third version of the invention, as seen in FIG. 26, requires the user to adjust arid attach straps 127 having hook VELCRO with respect to strips 128 having loop VELCRO.

Use of the fourth version of the invention, as seen in FIGS. 7 and 8, requires only that the user put on and wear the shoes 51 having the dense material 53 in the padded upper portion 52. The mass of material 53 will give the user additional exercise as the user moves his feet and legs.

The use of fifth and sixth versions of the invention, seen in FIGS. 17–21, is very similar. The user simply puts each hand into a glove 140, 170 and adjusts the tabs 149, 150, having oppositely sexed velcro coverings, until the wrist encircling weight unit 146 is firmly mounted on the wrist. The fifth version of the invention requires each finger be put through glove fingers and thumbs 143, 154, while the sixth version of the invention only requires that the index finger, second finger and thumb be put through loops 171, 172, 173 The user then goes about a typical exercise routine, which is magnified due to the mass of the weight unit 146.

The use of seventh version of the invention, seen in FIGS. 1 and 2, requires that the user insert a foot into partial sock 204. The toe portion of the user's foot will protrude from toe end opening 206, while the heal will protrude from heal opening 205. The resiliently elastic covering 202 stretches slightly when the user's leg is present, and therefore tends to hold the weight unit 200 firmly in place. The user is now ready for athletics and exercise that are typically performed shoeless, such as martial arts or ballet.

The eighth version of the invention, seen in FIGS. 3–5, is similar to the seventh, but requires the user to adjust loop and hook VELCRO patches 237, 238 into mating engagement, and requires that upper and lower VELCRO attachment straps 231, 232 be attached to upper and lower VELCRO attachment strips 233, 234 by overlapping the ends of the cover in overlap area 235.

The previously described versions of the present invention have many advantages, including the physiological benefits of aerobic exercise combined with the strength training advantages of weight resistance. All versions of the invention combine the advantages of a weight positioned at the end of a limb for of greatest leveraged resistance with the least weight. All versions provide an adjustable restraint, to overcome problems of holding the weight firmly against the limb. All versions provide an anchoring structure that holds the weight at the end of the limb, and prevents it from traveling up and down the limb, without requiring the user to grip the weight.

The versions of the invention seen in FIGS. 14, 16, and 24–26 provide the additional advantage of being adaptable to use with any existing pair of shoes, and provide structures having new and novel means to attach and maintain the weight unit.

The versions of the invention seen in FIGS. 17–21 provide the user with bare fingertips for added coordination. The version of the invention seen in FIG. 20 additionally provides the user with the safety of a bare palm, for a better grip, while the version of the invention seen in FIG. 17 provides the added protection of a covered palm, which is often useful when lifting weights.

Although the present invention has been described in considerable detail and with reference to certain preferred versions, many variations are possible. For example, the sex of the VELCRO (hook or loop) can in most instances be reversed without departing from the spirit of the invention. Therefore, the spirit and scope of the appended claims should not be limited to the description of the preferred versions contained here.

What is claimed is:

1. An exercise weight, attachable to a collar portion of an athletic shoe, comprising:

(a) a weight unit comprising:

(a) a cover having a first end portion and a second end portion;

(b) high-density material, contained within the cover;

(c) a first: strip of a first sex of VELCRO, arrayed lengthwise on the cover;

(d) a second strip of a second sex of VELCRO, arrayed lengthwise on the cover in a position that is adjacent and parallel to the first strip of VELCRO; and (e) adjustable restraint means for attaching the two end portions of the cover, thereby holding the weight unit against an ankle of a user; and (b) convertible band means, having a first side and a second side, for attaching a weight unit to the top of an athletic shoe comprising:

(a) an adhesive strip, on the first side of the convertible band means, for attaching the convertible band to the collar portion of an athletic shoe;

(b) a third strip of VELCRO on the second side of the convertible band;

(c) a fourth strip of VELCRO on the second side of the convertible band, the third and fourth VELCRO strips having opposite sexes and having a parallel relationship; and (d) a fold line in the convertible VELCRO attachment means, whereby the third strip of VELCRO may be moved from a lower position engaging the fourth strip of loop VELCRO to an upper position wherein the third and fourth strips of VELCRO on the convertible band may engage the first and second strips of VELCRO of the weight unit.

2. The exercise weight of claim 1, in which the adjustable restraint means comprises:

(a) a tab having a shoe lace hole attached to each end portion of the cover, whereby the user may use the laces of the athletic shoe to bias the weight unit against the user's ankle.

3. The exercise weight of claim 1, in which the adjustable restraint means comprises:

(a) a tab having a slot attached to the first end portion of the cover; and (b) a strap attached to the second end portion of the cover, the strap having a base having a covering of a first sex of VELCRO and an elongate portion having a covering of an oppositely sexed VELCRO, the elongate portion of the strap being sized appropriately to be inserted into the slot of the tab, thereby allowing the user to fasten the first end of the cover to the second end of the cover.

4. The exercise weight of claim 1, in which the adjustable restraint means comprises:

(a) a strap having a first sex of VELCRO attached to the first end portion of the cover; and (b) a strip having a second sex of VELCRO attached to the second end portion of the cover, thereby allowing the user to fasten the first end of the cover to the second end of the cover.

5. An exercise weight, attachable to a collar portion of an athletic shoe, comprising:

(a) a weight unit comprising:

(a) a cover having a first end portion and a second end portion;

(b) high-density material, contained within the cover;

(c) a first strip of a first sex of VELCRO, arrayed lengthwise on the cover;

(d) a second strip of a second sex of VELCRO, arrayed lengthwise on the cover in a position that is adjacent and parallel to the first strip of VELCRO; and (e) adjustable restraint means for attaching the two end portions of the cover, thereby holding the weight unit against an ankle of a user, comprising:

(a) a tab having a slot attached to the first end portion of the cover; and (b) a strap attached to the second end portion of the cover, the strap having a base having a covering of a first sex of VELCRO and an elongate portion having a covering of an oppositely sexed VELCRO, the elongate portion of the strap being sized appropriately to be inserted into the slot of the tab, thereby allowing the user to fasten the first end of the cover to the second end of the cover; and (b) convertible band means, having a first side and a second side, for attaching a weight unit to the top of an athletic shoe comprising:

(a) adhesive means, on the first side of the convertible band means, for attaching the convertible band to the collar portion of an athletic shoe;

(b) a third strip of VELCRO on the second side of the convertible band;

(c) a fourth strip of VELCRO on the second side of the convertible band, the third and fourth VELCRO strips having opposite sexes and having a parallel relationship; and (d) a fold line in the convertible VELCRO attachment means, whereby the third strip of VELCRO may be moved from a lower position engaging the fourth strip of loop VELCRO to an upper position wherein the third and fourth strips of VELCRO on the convertible band may engage the first and second strips of VELCRO of the weight unit.

* * * * *